US005279772A

United States Patent [19]

Eckhardt et al.

[11] Patent Number: 5,279,772

[45] Date of Patent: Jan. 18, 1994

[54] LIQUID DETERGENTS CONTAINING SPECIFICALLY DISULFONATED DIBENZOFURANYL-BIPHENYLS AS FLOURESCENT WHITENING AGENTS

[75] Inventors: Claude Eckhardt, Riedisheim, France; Kurt Weber, Basle, Switzerland

[73] Assignee: Ciba-Geigy Corporation, Ardsley, N.Y.

[21] Appl. No.: 13,482

[22] Filed: Feb. 1, 1993

Related U.S. Application Data

[63] Continuation of Ser. No. 750,713, Aug. 20, 1991, abandoned, which is a continuation of Ser. No. 514,999, Apr. 24, 1990, abandoned.

[30] Foreign Application Priority Data

Apr. 28, 1989 [CH] Switzerland ..... 1630/89

[51] Int. Cl.[5] ..... C11D 1/83; C11D 3/40; C11D 3/42

[52] U.S. Cl. ..... 252/558; 252/89.1; 252/95; 252/96; 252/99; 252/102; 252/559; 8/648

[58] Field of Search ..... 252/89.1, 95, 96, 99, 252/102, 542, 558, 559; 8/648

[56] References Cited

U.S. PATENT DOCUMENTS

| | | | |
|---|---|---|---|
| 3,859,350 | 1/1975 | Sahm et al. | 252/99 |
| 3,940,340 | 2/1976 | Bücking et al. | 252/99 |
| 4,002,423 | 1/1977 | Sahm et al. | 252/558 |
| 4,559,169 | 12/1985 | Wevers et al. | 252/543 |
| 4,670,882 | 6/1987 | Telle et al. | 372/53 |

FOREIGN PATENT DOCUMENTS

| | | |
|---|---|---|
| 0293040 | 11/1988 | European Pat. Off. . |
| 0321715 | 6/1989 | European Pat. Off. . |
| 3900651 | 7/1989 | Fed. Rep. of Germany . |
| 2041968 | 9/1980 | United Kingdom . |

*Primary Examiner*—Paul Lieberman
*Assistant Examiner*—Michael P. Tierney
*Attorney, Agent, or Firm*—George R. Dohmann; Marla J. Mathias

[57] ABSTRACT

The present patent application describes novel liquid detergent compositions containing specifically disulfonated dibenzofuranylbiphenyls of the formula

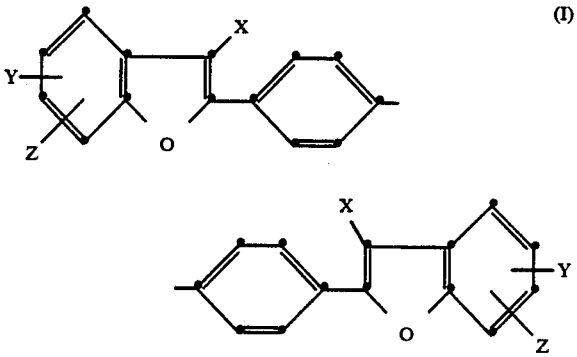

(I)

in which X is a sulfonic acid radical, hydrogen or $C_1$-$C_4$ alkyl and Y and Z independently of the other are a sulfonic acid radical, hydrogen, $C_1$-$C_4$ alkyl, $C_1$-$C_4$ alkoxy, halogeno, CN, phenoxy or benzyloxy, with the proviso that either X or Y or Z is a sulfonic acid radical and the remaining substituents are not a sulfonic acid radical, and the preparation and use thereof; these detergent compositions prevent spotting on textile fabric when it comes into direct contact with the liquid detergent composition.

9 Claims, No Drawings

LIQUID DETERGENTS CONTAINING SPECIFICALLY DISULFONATED DIBENZOFURANYL-BIPHENYLS AS FLOURESCENT WHITENING AGENTS

This case is a continuation of Ser. No. 07/750,713, filed Aug. 20, 1991, now abandoned which is a continuation of Ser. No. 07/514,999 filed Apr. 24, 1990, now abandoned.

The present invention relates to novel liquid detergent compositions containing specifically disulfonated dibenzofuranylbiphenyls as fluorescent whitening agents, to the preparation thereof and to the use thereof.

The use of fluorescent whitening agents in liquid detergent compositions is known. During the treatment, they exhaust on to the material to be washed and, through their special light absorption/emission property, they result in the elimination of the yellowish shades or an improvement in the degree of whiteness.

However, this effect is also responsible for the appearance of bleach spots when textile fabric comes into direct contact with the liquid detergent composition, e.g. during a pretreatment. To solve this problem, European patent application A-167 205 proposes the use of monosulfonated stilbenetriazolyl, stilbenetriazine or distyrylbiphenyl whitening agents in anionic liquid detergent compositions.

Suprisingly, the formation of bleach spots can also be prevented by fluorescent whitening agents of the formula

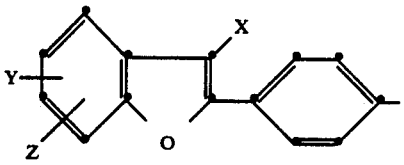

(I)

-continued

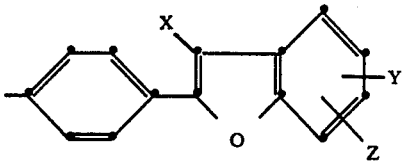

the liquid detergent composition having an excellent white effect and very good storage properties.

Specifically: X is a sulfonic acid radical, hydrogen or $C_1$–$C_4$ alkyl and Y and Z independently of the other are a sulfonic acid radical, hydrogen, $C_1$–$C_4$ alkyl, $C_1$–$C_4$ alkoxy, CN, halogeno, phenoxy or benzyloxy, with the proviso that either X or Y or Z is a sulfonic acid radical and the remaining substituents are not a sulfonic acid radical.

Preferred halogens are fluorine, chlorine and bromine, but chlorine is especially preferred.

Suitable $C_1$–$C_4$ alkyl radicals (or $C_1$–$C_4$ alkoxy radicals) are unbranched or branched alkyl (or alkoxy) radicals. These alkyl (or alkoxy) radicals can in turn be substituted by e.g. aryl (phenyl, naphthyl), $C_1$–$C_4$ alkyl, $C_1$–$C_4$ alkoxy, OH or CN groups.

Preferred dibenzofuranylbiphenyls of formula (I) are those of the formula

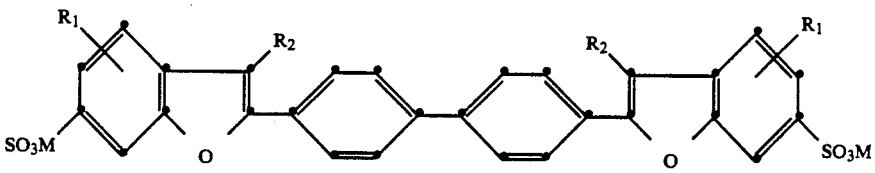

(II)

or

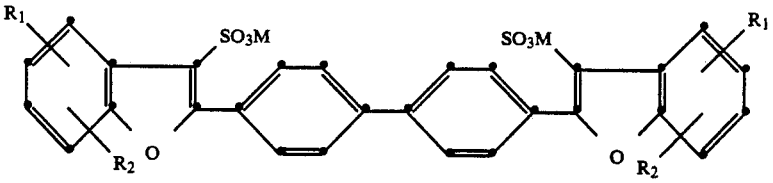

(III)

in which $R_1$=hydrogen, $C_1$–$C_4$ alkyl, chloro, $C_1$–$C_4$ alkoxy, phenoxy or benzyloxy, $R_2$=hydrogen or $C_1$–$C_4$ alkyl and M=hydrogen and/or one equivalent of a non-chromophoric cation.

M as a non-chromophoric cation is preferably an alkali metal such as lithium, sodium or potassium, or substituted or unsubstituted ammonium such as ammonium, mono-, di- or tri-ethanolammonium, mono-, di- or tri-propanolammonium or tri- or tetra-methylammonium.

However, especially preferred compounds are those of the formula

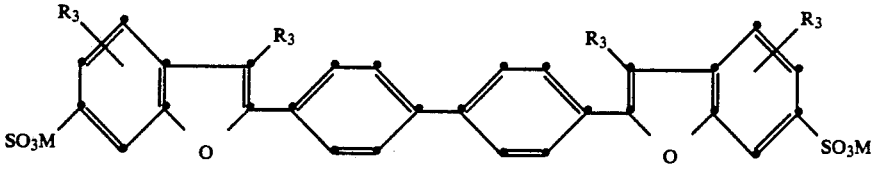

(IV)

or

-continued

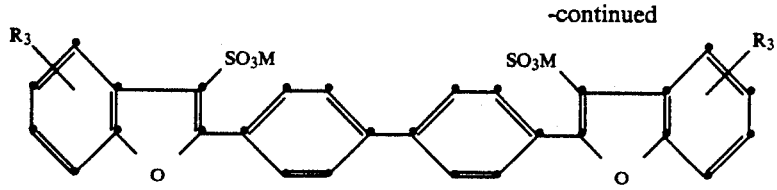

(V)

in which the radicals $R_3$ independently of the others are hydrogen, methyl or ethyl and M is preferably sodium or potassium.

The fluorescent whitening agents can be prepared by a) reacting one mol of a compound of formula (X):

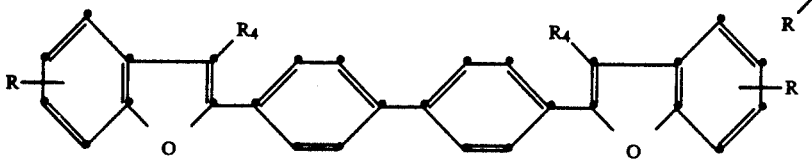

which can be polysubstituted by radicals R=hydrogen, $C_1$-$C_4$ alkyl, $C_1$-$C_4$ alkoxy, halogeno, phenoxy and benzyloxy, $R_4$ being hydrogen or $C_1$-$C_4$ alkyl, with at least stoichiometric amounts of an $SO_3$/base complex, in an inert organic solvent, at temperatures in the range from 20° C. to the boiling point of the solvent used, or b) reacting one mol of a compound of formula (X) with at least stoichiometric amounts of chlorosulfonic acid, in an inert organic solvent, at temperatures in the range from 0° C. to 40° C., or c) heating a compound of formula (X) with concentrated sulfuric acid or with sulfuric acid/glacial acetic acid or oleum/glacial acetic acid at temperatures in the range from 40° C. to 140° C., or d) etherifying one mol of a 4,4'-bis(halogenomethyl)-biphenyl with at least 2 mol of salicylaldehyde or its anils of formula (XI) or (XII):

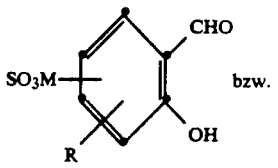

(XI)

-continued

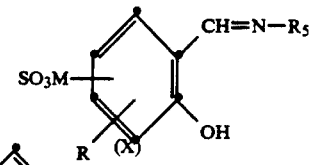

(XII)

which can be polysubstituted by radicals R=hydrogen, $C_1$-$C_4$ alkyl, $C_1$-$C_4$ alkoxy, halogeno, phenoxy and benzyloxy and in which M=hydrogen and/or one equivalent of a non-chromophoric cation and $R_5$=phenyl or chlorophenyl, and cyclizing the resulting bisbenzyl ethers of formula (XIII) or (XIV):

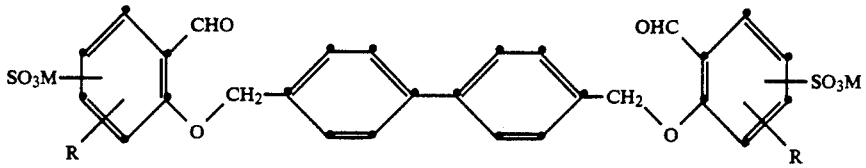

(XIII)

or

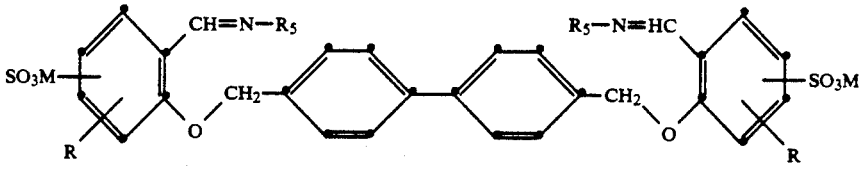

(XIV)

with bases.

The starting compounds of formulae (X), (XI) and (XII) are known and can be prepared by known methods. Advantageously, however, process d) is carried out as a one-pot process without isolation of the intermediates (XIII) and (XIV).

Specifically, the compounds of formulae (III) and (IV) are prepared by process a).

The term $SO_3$/base complexes will be understood as meaning addition compounds of $SO_3$ on to organic bases, e.g. dioxane, and preferably nitrogenous bases such as triethylamine, N-ethyldiisopropylamine, dimethylformamide (DMF) and, in particular, pyridine, the stability of these addition compounds being decisive for the degree of sulfonation. Thus, for example, compounds of formulae (III) and (V) are prepared by using 2 to 6 or especially 3 to 5 mol of $SO_3$/pyridine complex (based on the $SO_3$ content) per mol of the compound of formula (X). $SO_3$/base complexes are known and can be prepared by known methods (E. E. Gilbert, E. P. Jones, Ind. Enging. Chem. 49, no 9, part II, p. 1553 et seq. (1957); Beilstein 20, III/IV, 2232).

Examples of inert organic solvents are saturated aliphatic hydrocarbons such as gasoline, petroleum ether and ligroin, halogenated aliphatic hydrocarbons such as chloroform, carbon tetrachloride, dichloroethane, trichloroethane, tetrachloroethane, dichloropropane, trichloropropane, dichlorodifluoromethane and dichlorotetrafluorethane, chlorobenzenes such as mono-, di- and tri-chlorobenzene, nitrobenzenes such as nitrobenzene and nitrotoluene, and dicyclic hydrocarbons such as cyclohexane, methylcyclohexane and decalin.

The compounds of formulae (II) and (IV), in particular, are prepared by process c).

The etherification in process d) is carried out at temperatures in the range from 60° to 140° C. and especially 100° to 120° C., in known manner, by means of one equivalent of a base such as a tertiary amine or a base mentioned for the following cyclization, or by using the compounds of formula XI or XII already in the form of the phenate of this base. The reaction is carried out in a polar aprotic solvent or solvent mixture, for example dimethylformamide, N-methylpyrrolidone, hexamethylphosphoric triamide, tetramethylurea or, preferably, dimethyl sulfoxide.

The cyclization in process d) is also carried out in a polar aprotic solvent, preferably in the same one as that used for the etherification, at temperatures slightly higher than those used for the etherification, and in the presence of a base, e.g. quaternary ammonium bases, alkaline earth metal hydroxides, alkali metal amides, alkali metal hydrides, alkali metal carbonates or, preferably, alkali metal alcoholates such as potassium t-butylate and sodium methylate, and especially alkali metal hydroxides such as sodium, potassium and lithium hydroxide. The basic condensation agents are used in at least stoichiometric amounts, preferably in excess. The reaction is preferably carried out in the absence of atmospheric oxygen and under an inert gas atmosphere.

The term liquid detergent compositions will be understood as meaning known and commercially available detergent compositions such as those described in European patent application A-167 205, U.S. Pat. No. 4,507,219 or British patent 8712430.

The content of fluorescent whitening agent in the liquid detergent compositions is 0.01–2%, preferably 0.01–1% and most preferably 0.03–0.3%.

In particular, in addition to the fluorescent whitening agents, the liquid detergent compositions contain 1 to 60% of anionic, non-ionic, zwitterionic and, if desired, cationic surfactants and 25 to 65%, preferably 40 to 55%, of water. Specifically, in addition to the fluorescent whitening agent, the detergent composition contains 3 to 50%, preferably 15 to 25%, of anionic surfactants, 2 to 30%, preferably 4 to 15%, of non-ionic surfactants, 3 to 30%, preferably 5 to 20%, of ethoxylated or non-ethoxylated $C_{10}$–$C_{14}$ fatty acids such as capric acid, lauric acid, myristic acid, coconut fatty acid and palm kernel fatty acid and mixtures thereof, 1 to 25%, preferably 1 to 10%, of builders and, if desired, 1 to 10%, preferably 1 to 5%, of zwitterionic surfactants, 0.5 to 3%, preferably 0.7 to 2%, of quaternary ammonium, amine or amine oxide surfactants and 1 to 10% of conventional additives such as enzymes, enzyme stabilizers, antioxidants, preservatives and disinfectants, fragrances and colourants, complexing or sequestering agents and solvents.

Useful surfactants are described e.g. in U.S. Pat. Nos. 4,285,841, 3,929,678 and 4,284,532 and British patent 2 041 968. The surfactants indicated in European patent application A-167 205 as being preferred are used in particular. It is most preferable, however, to use ethoxylated or non-ethoxylated $C_{10}$–$C_{18}$ alkylsulfates, e.g. in the form of the triethanolamine salts, $C_{10}$–$C_{15}$ alkylbenzenesulfonates or mixtures thereof as anionic surfactants and condensation products of one mol of $C_{10}$–$C_{15}$ fatty alcohol with 3 to 8 mol of ethylene oxide as non-ionic surfactants.

Suitable builders are the preferably polycarboxylated compounds mentioned in U.S. Pat. Nos. 4,321,165 and 4,284,532, for example citric acid.

Specifically sulfonated dibenzofuranylbiphenyls containing liquid detergent compositions can also contain bleaching agents, as described e.g. in British patent 8712430. Perborate is preferably used as the bleaching agent.

The following Examples will serve to illustrate the invention; parts and percentages are by weight; the spotting test is carried out in the following manner:

a) Whitening agent/detergent composition formulation: 0.1% (100% of active substance) of fluorescent whitening agent or mixture of whitening agents is dissolved in a liquid detergent composition. 0.6 g of this detergent composition (A) containing whitening agent is diluted with 400 ml of water (10°–12° of hardness) at a temperature of 30° C. (wash liquor B).
b) A 20 g piece of bleached cotton fabric is fastened to a tenter frame.
c) Using a pipette, 0.6 ml of the solution of detergent composition (A) is uniformly applied to a premarked round area (5 cm diameter) of this cotton fabric and, after an exposure time of 30 seconds, the fabric is placed in the prepared wash liquor (B) and washed for 15 minutes at 30° C. It is then rinsed with cold water and dried at 70° C.
d) The difference in the degree of whiteness measured according to the method of Ganz between the treated area and the surrounding area is a measure of the so-called spotting behavior (formation of bleach spots) and is determined for a single-ply textile with a Zeiss RFC3 photometer.

EXAMPLE 1

A liquid detergent composition comprising 15 parts of $C_{11}$–$C_{13}$ alkylbenzenesulfonate
14 parts of $C_{14}$–$C_{15}$ polyethoxylated fatty alcohol (7 ethylene oxide)
10 parts of soap
9 parts of ethanol
5 parts of triethanolamine
4 parts of sodium citrate
43 parts of water
and 0.1 part of the fluorescent whitening agent of the formula

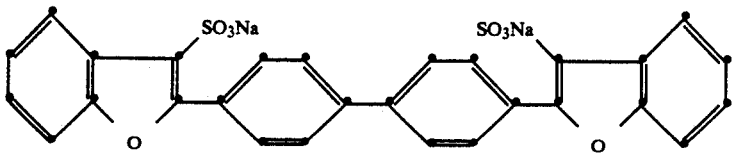

(100)

is prepared.

The spotting test shows only very insignificant spotting, the degree of whiteness being very high.

The detergent formulation is stable on storage.

EXAMPLE 2

A liquid detergent composition is prepared as in Example 1, except that it contains the compound of the formula

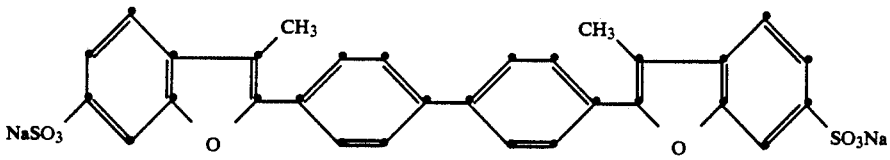

(200)

instead of compound (100).

As regards its properties, the liquid detergent composition is identical with that of Example 1.

EXAMPLE 3

A liquid detergent composition is prepared as in Example 1, except that it contains the compound of the formula

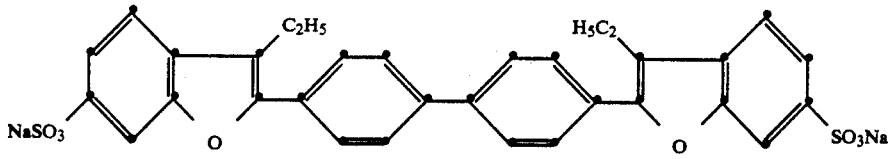

(300)

instead of compound (100).

As regards its properties, the liquid detergent composition is identical with that of Example 1.

EXAMPLE 4

A liquid detergent composition is prepared as in Example 1, except that it contains the compound of the formula

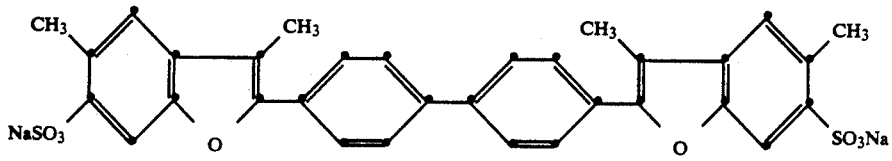

(400)

instead of compound (100).

The detergent formulation is very stable on storage.

The spotting test shows only very insignificant spotting.

EXAMPLE 5

A liquid detergent composition is prepared as in Example 1, except that it contains the compound of the formula

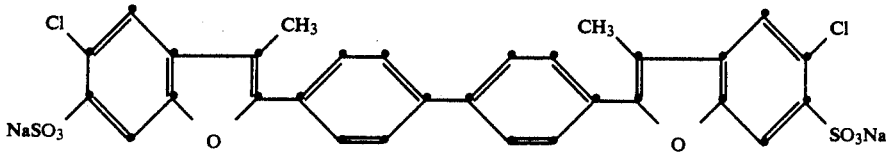

(500)

instead of compound (100).

The detergent formulation is very stable on storage.

The spotting test shows only insignificant spotting, the white effects being high.

EXAMPLE 6

A liquid detergent composition comprising 6.5 parts of triethanolamine
3.5 parts of NaOH
6.5 parts of ethanol
1.5 parts of propane-1,2-diol
11.5 parts of $C_{14}$–$C_{15}$ polyethoxylated fatty alcohol (7 ethylene oxide)
2.5 parts of coconut fatty alkylsulfate
10.5 parts of linear dodecylbenzenesulfonic acid
4.0 parts of oleic acid
10.5 parts of saturated $C_{12}$–$C_{14}$ acid
43.0 parts of deionized water and 0.1 part of the fluorescent whitening agent of the formula

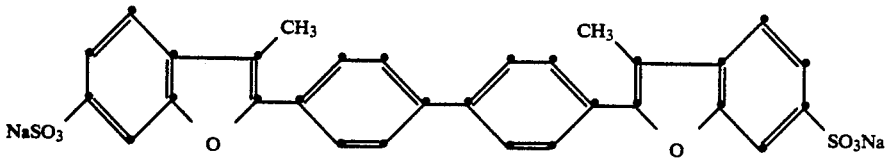

(200)

is prepared.

The detergent composition is opaque, homogeneous and very stable on storage. The spotting test shows only very insignificant spotting, the degree of whiteness being very high.

EXAMPLE 7

A liquid detergent composition is prepared as in Example 6, except that it contains the compound of the formula

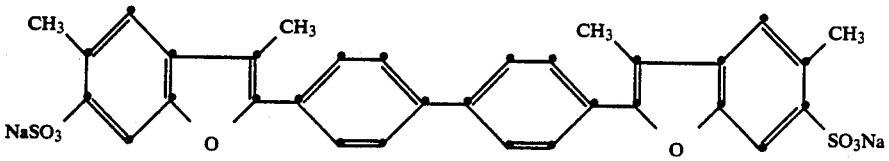

(400)

instead of compound (200).

As regards its properties, the liquid detergent composition is identical with that of Example 6.

What is claimed is:

1. A storage stable liquid detergent composition which, based on the weight of the detergent composition, consists essentially of:

a) 0.01 to 2% of a fluorescent whitening agent of the formula:

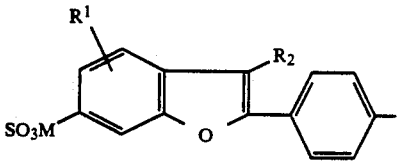

(II)

-continued

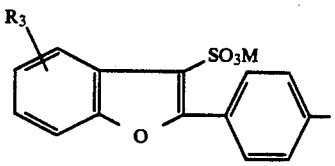

(V)

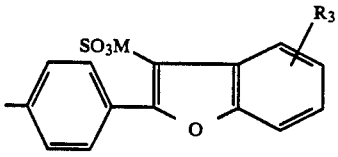

in which $R_1$ is hydrogen, $C_1$–$C_4$alkyl, chloro, $C_1$–$C_4$alkoxy, phenoxy or benzyloxy, $R_2$ is hydrogen or $C_1$–$C_4$alkyl, $R_3$ is hydrogen, methyl or ethyl and each M is independently hydrogen or one equivalent of a non-chromophoric cation;

b) 3 to 50% of an anionic surfactant;

c) 2 to 30% of an non-ionic surfactant, except an ethoxylated $C_{10}$–$C_{14}$ fatty acid;

d) 3 to 30% of an ethoxylated or non-ethoxylated fatty acid;

e) 25 to 65% of water; and f) 1 to 25% of a builder.

2. A liquid detergent composition according to claim 1 which contains a fluorescent whitening agent of the formula

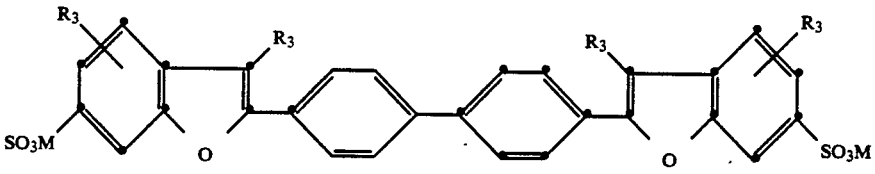

(IV)

or

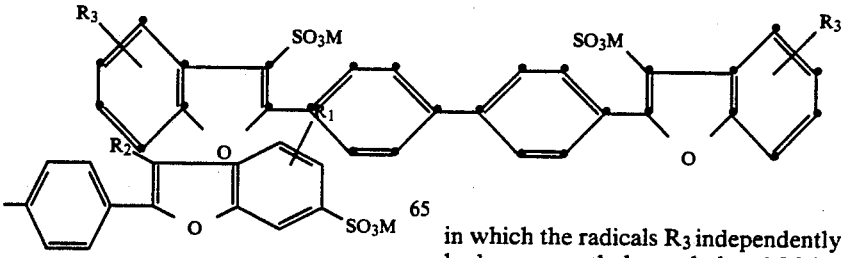

(V)

or in which the radicals $R_3$ independently of the others are hydrogen, methyl or ethyl and M is sodium or potassium.

3. A liquid detergent composition according to claim 1 which contains a fluorescent whitening agent of the formula

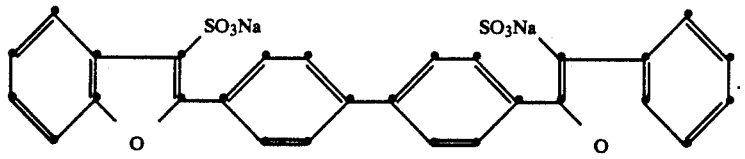

(100)

4. A liquid detergent composition according to claim 1 which contains a fluorescent whitening agent of the formula

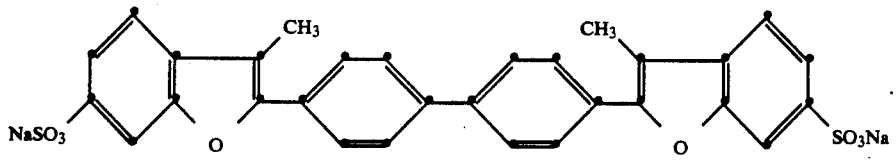

(200)

5. A liquid detergent composition according to claim 1 which contains a fluorescent whitening agent of the formula

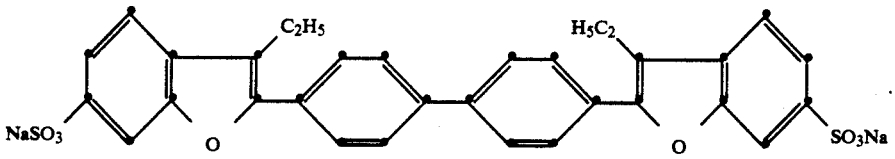

(300)

6. A liquid detergent composition according to claim 1 which contains a fluorescent whitening agent of the formula

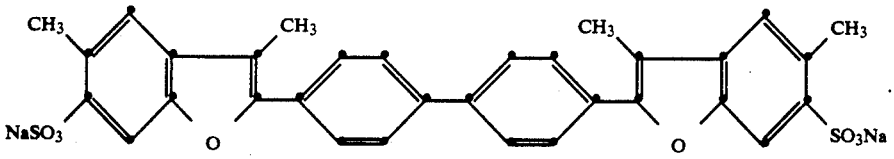

(400)

7. A liquid detergent composition according to claim 1 which contains a fluorescent whitening agent of the formula

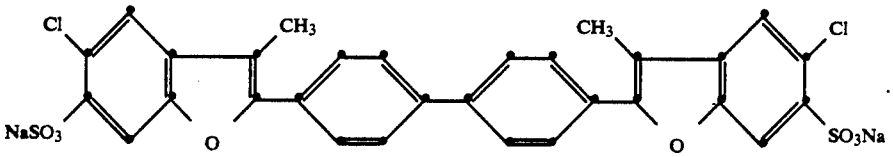

(500)

8. A liquid detergent composition of 1 which consists essentially of (a) 0.01 to 1% of the fluorescent whitening agent,
(b) 15 to 25% of the anionic surfactant,
(c) 4 to 15% of the non-ionic surfactant except ethoxylated $C_{10}$–$C_{14}$ fatty acids,
(d) 5 to 20% of the ethoxylated or non-ethoxylated $C_{10}$–$C_{14}$-fatty acid,
(e) 40 to 55% of water, and
(f) 1 to 10% of the builder.

9. A method of washing and pretreating textiles which comprises placing the textile in a wash liquor prepared by diluting a liquid detergent composition of claim 1 with additional water to a ratio sufficient to facilitate the even distribution of the composition in the textile while still providing an amount of composition sufficient to improve the degree of whiteness in the textile.

* * * * *